US011358750B2

(12) United States Patent
Piech

(10) Patent No.: US 11,358,750 B2
(45) Date of Patent: Jun. 14, 2022

(54) RESEALABLE CAN LID

(71) Applicant: Gregor Anton Piech, Ellmau (AT)

(72) Inventor: Gregor Anton Piech, Ellmau (AT)

(73) Assignee: Gregor Anton Piech, Ebbs (AT)

( * ) Notice: Subject to any disclaimer, the term of this patent is extended or adjusted under 35 U.S.C. 154(b) by 783 days.

(21) Appl. No.: 16/081,180

(22) PCT Filed: Feb. 7, 2017

(86) PCT No.: PCT/EP2017/052626

§ 371 (c)(1),
(2) Date: Aug. 30, 2018

(87) PCT Pub. No.: WO2017/148659

PCT Pub. Date: Sep. 8, 2017

(65) Prior Publication Data

US 2019/0055053 A1 Feb. 21, 2019

(30) Foreign Application Priority Data

Mar. 3, 2016 (DE) ..... 10 2016 103 801.6

(51) Int. Cl.
*B65D 17/28* (2006.01)

(52) U.S. Cl.
CPC ..... *B65D 17/4014* (2018.01); *B65D 17/404* (2018.01); *B65D 2517/0007* (2013.01); *B65D 2517/0016* (2013.01); *B65D 2517/0026* (2013.01); *B65D 2517/0043* (2013.01); *B65D 2517/0044* (2013.01); *B65D 2517/0062* (2013.01); *B65D 2517/0082* (2013.01)

(58) Field of Classification Search
CPC .... B65D 2517/0013; B65D 2517/0014; B65D 2517/5064; B65D 2517/508; A47G 19/22; A47G 19/2272; B21D 51/44; B21D 51/46
USPC ..... 220/257.2, 256.1, 266.27; 215/255
See application file for complete search history.

(56) References Cited

U.S. PATENT DOCUMENTS 3,287,053 A * 11/1966 Stec ..... B65D 17/506 292/256.63
3,807,595 A 4/1974 Zundel
4,986,465 A 1/1991 Jacobsson et al.
5,443,175 A 8/1995 Kelly et al.
(Continued)

FOREIGN PATENT DOCUMENTS

CN 1764576 A 4/2006
CN 101687567 A 3/2010
(Continued)

*Primary Examiner* — Anthony D Stashick
*Assistant Examiner* — Raven Collins
(74) *Attorney, Agent, or Firm* — Vivacqua Crane PLLC

(57) ABSTRACT

The invention relates to a can lid of a conventional design, in particular intended for beverage cans, whose special feature comprises the fact that a substantially ring-shaped molded plastic part is fastened to the lower side of the lid surface surrounding the opening region to form an opening that is sealingly reclosable, in that a plastic stopper part is fixedly connected to the lower side of the tongue tab that is upwardly pivotable during the opening procedure and sealingly engages into the molded part, and in that the peripheral contour of the tongue tab is preferably disposed in the region of the molded part at a predefinable spacing from the stopper part.

24 Claims, 5 Drawing Sheets

(56) References Cited

U.S. PATENT DOCUMENTS

| | | | | |
|---|---|---|---|---|
| 9,901,200 | B2 | 2/2018 | Vanderstraeten | |
| 2004/0159665 | A1 | 8/2004 | Morrissey et al. | |
| 2010/0038372 | A1 | 2/2010 | Bratsch | |
| 2013/0020326 | A1 | 1/2013 | Thielen et al. | |
| 2014/0305942 | A1 | 10/2014 | Van Goolen | |
| 2016/0000246 | A1* | 1/2016 | Vanderstraeten .. | B65D 81/2053<br>220/270 |

FOREIGN PATENT DOCUMENTS

| | | | |
|---|---|---|---|
| DE | 8911286 | U1 | 12/1989 |
| DE | 9005150 | U1 | 8/1990 |
| DE | 19613246 | A1 | 10/1997 |
| EP | 1607341 | A1 | 12/2005 |
| EP | 2354022 | B1 | 12/2012 |
| GB | 1389351 | A | 4/1975 |
| WO | 9528329 | A1 | 10/1995 |
| WO | 9736794 | A1 | 10/1997 |
| WO | 2008098558 | A1 | 8/2008 |
| WO | 2011095319 | A1 | 8/2011 |

* cited by examiner

RESEALABLE CAN LID

CROSS-REFERENCE TO RELATED APPLICATIONS

This application is a national stage entry of PCT/EP2017/052626, filed Feb. 7, 2017, which claims priority to DE 10 2016 103 801.6, filed Mar. 3, 2016. The entire disclosures of the above applications are hereby incorporated by reference.

TECHNICAL FIELD

The invention relates to a can lid, in particular for beverage cans.

BACKGROUND

The invention relates to a can lid, in particular for beverage cans, having an opening region in the form of a tongue tab provided in the metallic lid material of a lid surface and in particular bounded by a material weakening, having a two-armed lever member that is intended for opening this opening region, that is in particular fixedly connected to the lid material in the opening region, in particular via a rivet connection or weld connection, and that serves for pivoting the tongue tab upwardly during the opening procedure.

Can lids of this kind are use to an extremely large degree all over the world. They can be manufactured simply and inexpensively and allow a space-saving stacking of the cans as well as an opening of the cans by a simple upward pivoting of the long arm of the lever member.

However, these generally known can lids have disadvantages that, for example, comprise a reclosing of a lid not being possible once it has been opened, the lid part region initially closing the opening region is pressed into the can interior on the upward pivoting of the lever member and on the opening of the can taking place in this process and there comes into contact with the liquid which is hygienically problematic, and tiny articles being unavoidably released from the lid material and being able to enter into the can interior during the opening procedure, i.e. when the weakening groove present in the lid material between the opening region and the lid surface is torn open or separated.

A can lid having a reclosable opening is known from WO 2011/095319 A1 in which the opening region of the can is formed as a closure lid and is connected at its outer margin adjacent to the tear notch with a collar part of a first plastic material in a force-transmitting manner and a lid receiving part of a second plastic material that is connected outside the opening region and adjacent to the tear notch to the lid surface in a force-transmitting manner is associated with the collar part. The collar part in this respect engages over the lid receiving part and a sealing snap-in connection having a peripheral coupling rib and a recess shaped in a complementary manner are formed between the collar part and the lid receiving material. The pull tab is fastened radially outside the lid receiving part to a fixing region of the collar part and the two-armed lever is formed to pierce the tear notch by a partial peripheral region of the collar part associated with the fixing region.

A can lid having a reclosable opening is known from EP 1 607 341 A1 in which an opening is introduced in the metallic can lid and the margin of this opening is beaded to create an anchorage possibility for a prefabricated plastic closure part. The plastic closure part encloses a base part which is to be connected to the bead rim of the can opening and in which an opening closed by a flat stopper is formed. The flat stopper is connected to the opening margin via a plastic tear seam so that the flat stopper connected to a tear tab can be released from the base plastic part via the tear tab by exertion of a pull and can be pivoted into an open position. The opening can be temporarily closed again by pressing in the flat stopper which is preferably conical at its lower side.

A can lid having a reclosable opening is known from WO 2008/098558 A1 in which an opening into which a prefabricated tearable plastic closure part is inserted is likewise introduced in the metal can lid, with the prefabricated plastic element having a double flange at the marginal side into which the margin of the stamped-out can opening engages and is fixed therein. The prefabricated plastic element includes a closure part which is connected to the peripheral margin of the plastic part via a tear seam. A tear tab connected to the closure part makes it possible to tear open the plastic tear seam between the peripheral region of the plastic part and the lid part and to release the can opening in this manner. For the purpose of reclosing, the closure part which preferably remains in connection with the peripheral region via a tab region is pressed back into the opening.

A reclosable can lid is known from GB 1 389 351 in which in particular the creation of sharp edges should be avoided such as occur on opening usual sheet metal cans via a tab. For this purpose, a punching provided in the metallic can lid is snapped into a prefabricated plastic part which has a lid part which is connected to the base part snapped into the can opening via a thin plastic wall. The thin connection wall between the connection part and the base part can be destroyed via a tear tab and the can opening can be exposed. The closure part is designed in this respect such that it engages into the base part via a snap-in latch connection to reclose the opening.

A beverage can is known from DE 89 11 286 U having a press-in lid closure in which the tear tab is rotatably supported at the lid wall and a closure element is provided thereat which is taken along on the rotation of the tear tab from the tear position into a closure position above the opened pouring opening and engages over or overlappingly into the pouring opening.

A beverage can is known from DE 90 05 150 U having a lid which is composed of sheet metal, in which an attenuating line is formed and the lid part bounded by the weakening line can be separated by means of a pull tab, with a closure part for the removal opening pivotable substantially in parallel with the lid surface being captively fastened to the lid.

A lid of metal for beverage cans is known from DE 196 13 246 which has a prepunched pouring opening in the lid surface which is tightly closed by means of a closure element and can be tightly closed again after the first opening. In this respect, the lid and the closure element can be connected to one another in a shape-matched manner by elements which engage into one another in the manner of a bayonet and which are formed directly out of the lid material or the closure element.

SUMMARY

It is the object of the present invention to adapt the can lid in accordance with the preamble of the claim in a manner such that a repeated, sealing reclosing of an open can is made possible and the procedure of opening the can is preferably also facilitated or the force effort required therefor is reduced. The construction design of the can lid should furthermore be made as simple and as inexpensive as possible and a problem-free automatic assembly should be made possible.

This object is substantially satisfied in that a substantially ring-shaped molded plastic part is fastened to the lower side of the lid surface surrounding the opening region to form an opening at the lower side of the lid surface that is sealingly reclosable, in that a plastic stopper part is fixedly connected to the lower side of the tongue tab that is upwardly pivotable during the opening procedure and sealingly engages into the molded part, and in that the peripheral contour of the tongue tab is preferably positioned in the region of the molded part at a predefinable spacing from the stopper part.

It is of particular importance in this solution that the elements decisive for the reclosing capability of the can are disposed in the inner space of the can and that the outer appearance of this reclosable can thus practically does not differ from a conventional can, i.e. a non-reclosable can, and in particular no plastic elements can be seen at the outer side of the can lid.

The can lid in accordance with the invention can thus be provided with a weakening groove in accordance with a basic embodiment analog to a conventional can lid, said weakening groove being pierced on an upward pivoting of the lever, whereupon the tongue tab bearing the stopper part can be pulled upward so that the opening becomes free. On the pivoting back of the tongue tab, the stopper then moves in a sealing manner again into the molded part sealingly receiving it where it is latchingly held until the next opening procedure. The opening and closing procedure can then be repeated as required.

In accordance with an advantageous embodiment of the invention, the stopper part is configured as a hollow stopper having a concave base wall and can be coupled to the molded part receiving it via a snap-in connection.

The concave design of the base wall produces the advantage in this respect that the concave base wall is deformed in the direction of the can lid due to the inner pressure present or building up in a can and the contact pressure of the peripheral stopper wall toward the wall of the ring-shaped molded part is thereby increased and thus the sealing is also further improved.

A further advantageous feature of the invention can be seen in the fact that the molded part and the stopper part are sealingly connected to the lid material via a sealing layer that preferably extends over the entire lower lid side.

The sealing layer in the form of a sealing wax or of a hard lacquer finish provided at the lower lid side can be activated by the effect of heat, e.g. at approximately 120° C., and allows an absolutely reliable and secure connection between the metal parts and the plastic parts.

The ring-shaped molded part preferably has a nose that is associated with the region of the tongue tab end and whose end region is fixedly connected to the lid material via the sealing layer.

It is possible in this manner to provide a free region between the ring-shaped molded part and the end region of the molded part nose, with said free region allowing an upward pivoting of the tongue tab bearing the closure stopper about a pivot bearing that has a sufficient spacing from the opening that becomes free to ensure an unimpeded drinking from the can.

It is of advantage from a technical production aspect if the molded part and the stopper part comprise an injection molded part connected via a flexible, separable tab since a problem-free automatic pivoting into one another of both parts and a completing further processing of the single-part structure obtained in this way can take place on the assembly in this manner.

An independent advantageous aspect of the invention is characterized in that the tongue tab connected to the stopper part at the lower side is separated from the lid surface by a microgap, in particular a stamped gap, extending over the periphery of the tongue tab and the tongue tab base connected to the lid surface forms a pivot bearing that becomes effective during the opening procedure, and in that the lower side of the metallic lid is coated in a firmly adhering manner with a sealing plastic material.

The presence of a microgap instead of a material weakening is of particular importance in this embodiment. The leak tightness of the can is ensured in this case by the molded plastic part that contacts the lower lid side in a sealingly adhering manner and that covers the microgap.

The microgap is preferably obtained by a punching procedure with a subsequent return of the tongue tab pressed out of the can lid material into its starting position before the punching. The opening of the can with a small force is a consequence of the fact that no separation of metal is necessary.

A further independent embodiment of the invention comprises the fact that the tongue tab of the metallic can lid is separated from the lid surface surrounding it by a cutting process, in particular a stamping process, while forming mutually engaging projections and recesses and that the tongue tab and the lid surface adjacent thereto are connected in a shape-matched and force-transmitting manner via the projections and recesses while forming a microgap.

After the opening procedure, the margin of the metallic lid material at the molded part side lies in a protected manner on the upper end wall of the ring-shaped molded part and the peripheral margin of the tongue tab formed in a complementary manner is very largely protected against contact by the stopper part borne by the tongue tab.

Different embodiments of the invention that are to be considered as independent aspects differ in that the microgap formed by the recesses and the projections extends in the manner of a dovetail, of a trapeze or of a wavy line in a mutually engaging manner.

In addition to the can lid described in detail, the invention also covers all cans that are provided with a can lid in accordance with the invention.

Further advantageous features of the invention result from dependent claims and from the following description of an embodiment of the invention with reference to the drawing.

DETAILED DESCRIPTION

Figure 1:
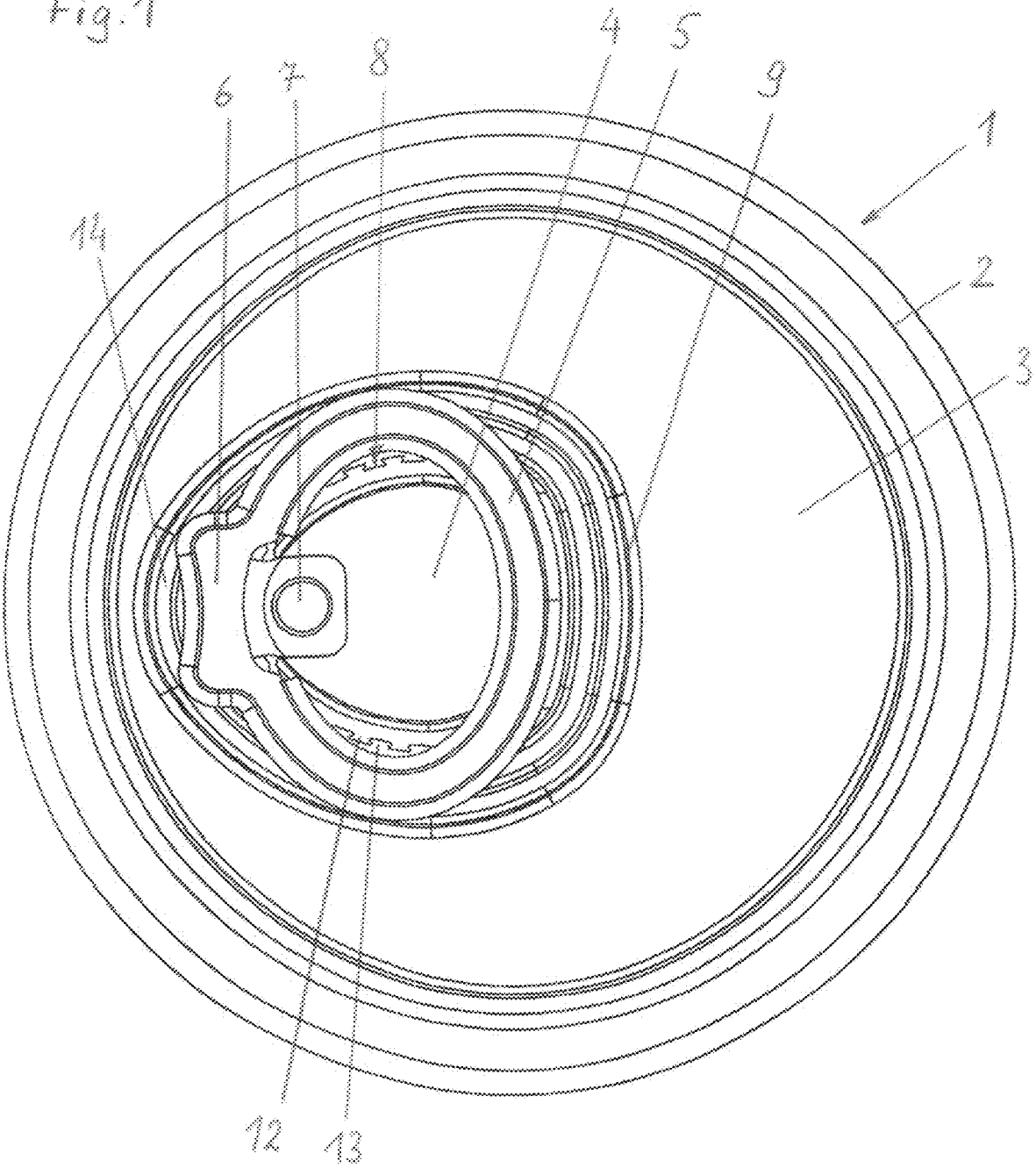
FIG. 1 is a plan view of an embodiment of a can lid in accordance with the invention.

FIG. 1 shows an embodiment of the can lid in accordance with the invention in a schematic plan view. This can lid is provided at its peripheral region with a bead rim 2 in a conventional manner, wherein the region disposed within the bead rim 2 is formed by a lid surface 3 that has an opening region formed as a tongue tab 4 offset with respect to the center. This metallic can lid comprising aluminum material is provided in a manner surrounding the opening region 4 with at least one stiffening region 14 formed by material deformation.

A two-armed lever 5, 6 is connected, in particular riveted or welded, to the tongue tab 4 of the can lid 1 defining the opening region such that a fixed connection point 7 results. This connection point 7 is disposed in the marginal region of the tongue tab 4 or of the opening region, i.e. opposite the tongue base that is connected to the lid surface 3 and that forms a pivot bearing region 9 during the opening procedure. The two-armed lever comprises a shorter region and a longer region, wherein the longer region is preferably formed by a ring tab 5 that can in particular be easily gripped due to a concave design of the opening region and the shorter region is formed by a support limb 6 that is supported on a stiffening region of the can lid easily absorbing the corresponding counter-forces on the upward pivoting of the longer lever. The opening region 4 is accordingly pried open on the upward pivoting of the longer lever, which will be presented in detail below.

The two-armed lever 5, 6 lies substantially in parallel with the lid surface 3 in the starting state such that the overall visual impression of the lid in the plan view substantially corresponds to a conventional can lid and the corresponding stacking properties of cans equipped with such a can are accordingly also ensured.

The tongue tab forming the opening region 4 is coupled in a shape-matched and force-transmitting manner to the lid surface 3 via projections 12 and recesses 13 and preferably via suitable undercuts of these parts, and indeed with the exception of the region of the tongue base where the opening region 4 and the lid surface 3 are connected in a metallic manner such that an upward pivoting of the tongue tab is made possible by means of the lever practically via a kind of folding joint 9 on the opening of the can and the tongue tab 4 and the lever 5, 6 can then move into a position of rest outside the inner can space while releasing the opening, in which position of rest a comfortable drinking from the can is ensured.

In this end position, that is reached after the upward pivoting of the tongue tab 4, a retaining effect with respect to the tongue tab is preferably achieved by a suitable bead formation in the material of the can surface and holds the tongue tab in the fully openly pivoted position out of which it can, however, be moved again by exerting a light pressure in the closing direction.

Figure 2:
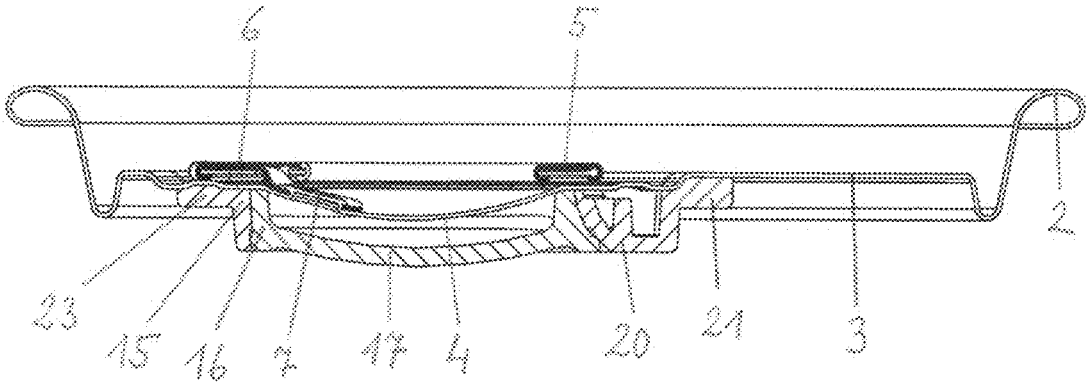
FIG. 2 is a sectional view of the can lid of FIG. 1.

FIG. 2, that shows a section through the can lid of FIG. 1, allows the elements and construction details to be recognized that are decisive for the reclosing capability of the can lid in accordance with the invention.

The total lower side of the metallic can lid is preferably covered by a sealing layer, in particular a heat sealing layer, that is naturally very thin and that is not shown in the drawing.

The required leak tightness of the can lid is ensured despite the lack of a continuous metal connection between the lid surface 3 and the tongue tab 4 in the region of the microgap 8 by a molded plastic part 15 that is sealingly connected to the lid material and that covers the microgap 8.

The substantially ring-shaped molded plastic part 15 that surrounds the opening region is fixedly connected to the lower side of the can surface 3 via the mentioned sealing layer. A plastic stopper part 16 is provided that is associated with this ring-shaped molded plastic part, that is received therein in a shape-matched manner, that is formed as a flat hollow stopper and whose end surface is in turn firmly connected to the metallic tongue tab 4 via the sealing layer. The stopper part 16 that forms a sealing closure element with respect to the ring-shaped molded part 15 is thus taken along on an upward pivoting of the tongue tab 4, i.e. the can is opened, and, on a backward pivoting of the tongue tab 4 into its original starting position, the stopper part 16 in turn sealingly engages into the ring-shaped molded part 15 and thus closes the can.

Figure 3:
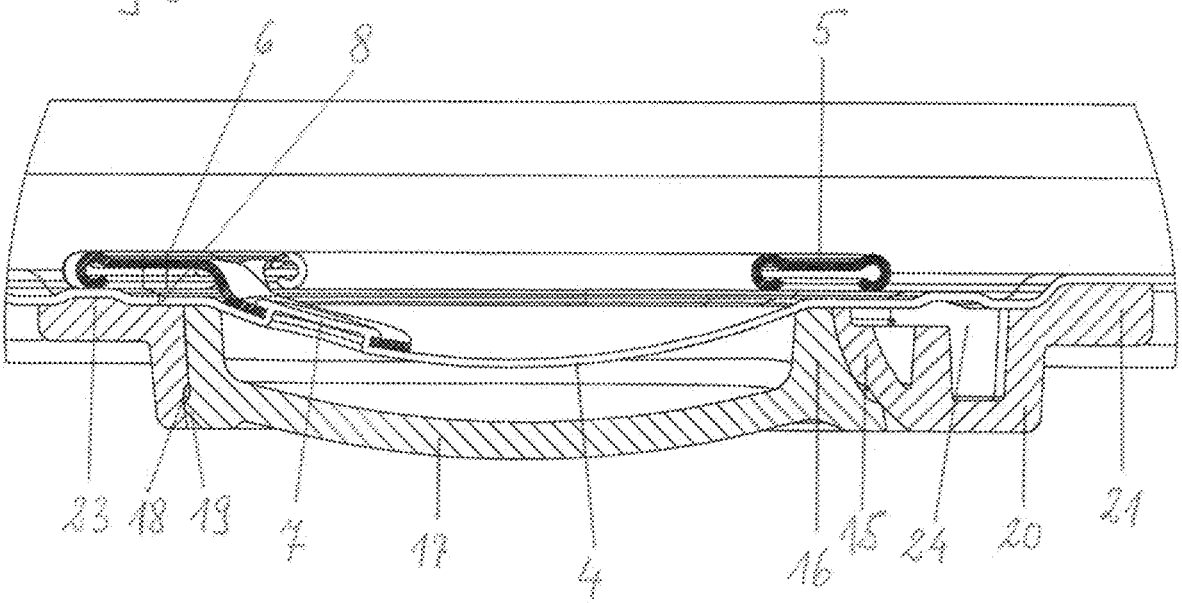
FIG. 3 is an enlarged detailed view of the closure region of FIG. 2.

The enlarged detailed representation of the functional region of the can lid in FIG. 3 shows further substantial details of the solution in accordance with the invention realized in this embodiment.

The molded part 15 sealingly and firmly connected to the lower side of the lid surface has a flange region or support region 23 that is associated with the short lever arm 6 and that can, together with the can surface, absorb the forces arising on the prying open of the tongue tab without problem.

Figure 5:
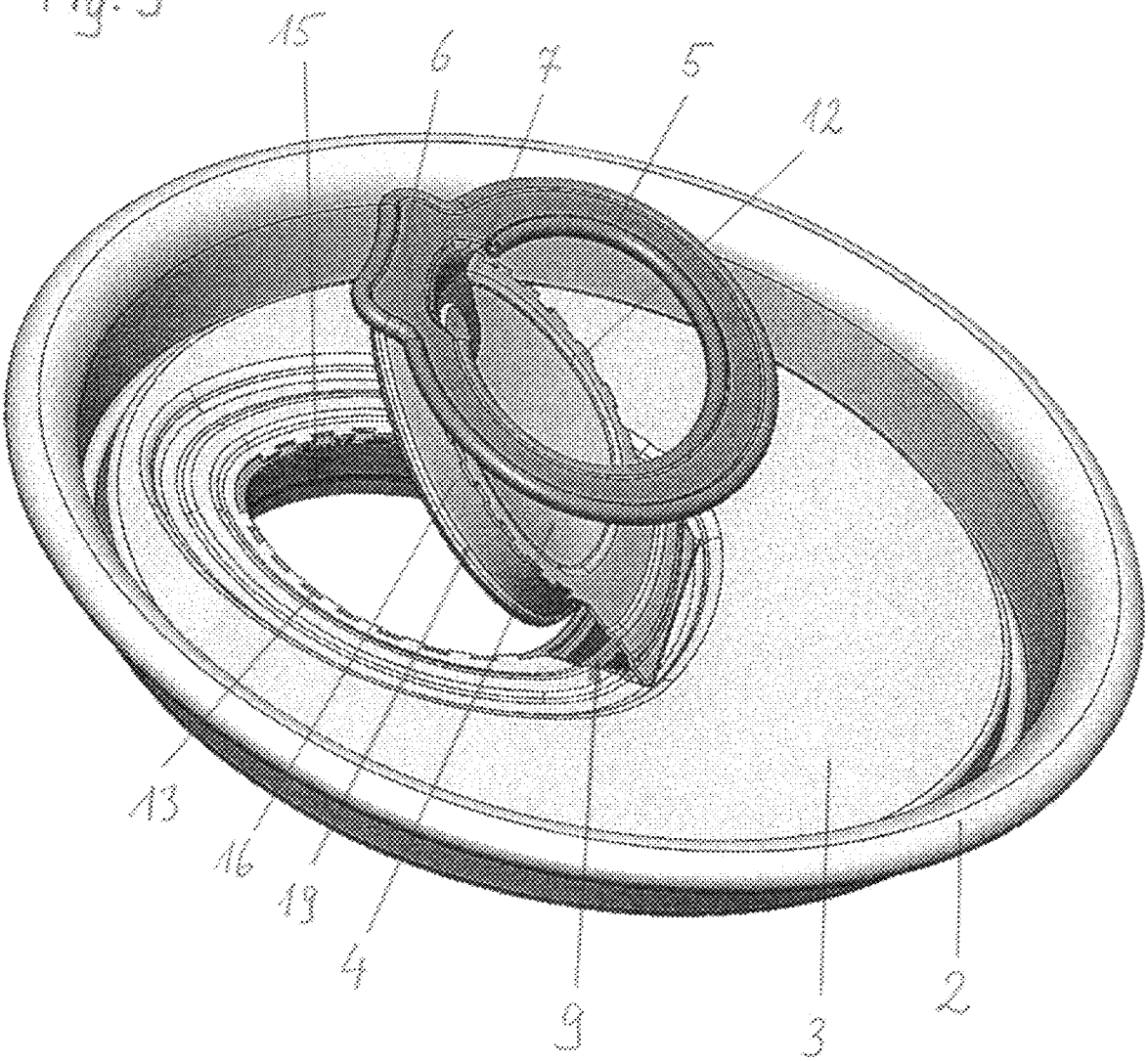
FIG. 5 is a perspective representation of the can lid of FIG. 1 in a partly exposed or open state.

Approximately diametrically opposed to this support region 23, the molded part 15 is provided with a nose region 20 that merges into an end region 21 in turn firmly and sealingly connected to the lid surface. A free space 24 is provided between the ring-shaped part of the molded part 15 and the end region 21 and allows an unimpeded upward pivoting of the tongue tab via a pivot bearing, as is illustrated in FIG. 5.

The ring-shaped inner wall of the molded part 15 and the outer wall of the stopper part 16 are designed with respect to their shapes such that an unimpeded inward and outward pivoting of the stopper part with respect to the pivot bearing is possible, with the stopper part engaging in a shape-matched and sealing manner into the ring-shaped molded part and with a snap-in connection between the stopper part and the molded part becoming effective in the closed state. For this purpose, the ring-shaped molded part 15 is provided in the region of its lower end with a preferably peripheral recess 18 into which a corresponding projection 19 at the stopper part can engage via adapted sloping surfaces, whereby the releasable latching of both parts is ensured.

The base wall 17 of the stopper part 16 is preferably concavely curved, whereby it is achieved that a spreading effect occurs in the stopper part due to the excess pressure that is present in the respective can that increases the pressing toward the inner molded part wall and thus increases the sealing between both parts.

It has already been emphasized that a microgap 8 is preferably provided between the tongue tab 4 and the lid surface 3. This microgap 8 can be formed in different manners, for example in the manner of a dovetail joint or in the form of a wave line preferably having undercut regions, with the position of this microgap 8 with respect to the separating line at the lid side between the molded part 15 and the stopper part 16 having to be taken into account independently of the respectively selected embodiment of the microgap 8.

FIG. 3 in particular allows it to be recognized that this microgap 8 is preferably disposed radially outside the mentioned separating line. The microgap 8 is accordingly located in the region of the connection surface of the molded part 15 to the lid material and extends at a small spacing from the separating gap between the molded part 15 and the stopper part 16.

The plastic sealing layer that cannot be seen in the representation in accordance with FIG. 3 and that is provided between the plastic elements 15, 16 and the lower side of the lid surface 3 can easily be peeled off on the opening of the can lid and on the pulling up of the tongue tab 4 and the stopper part 16 so that an opening of the can is made possible that takes place with a particularly small exertion of force.

To achieve this design of the can lid that works with a microgap and that precludes any formation of metal splinters on the opening of the can lid, the opening region or the tongue tab is separated from the surrounding lid surface by a cutting procedure or preferably by a punching procedure on the production of the can lid, wherein the splinters or microparticles that are thereby produced can be eliminated completely and without problem as part of the production process. The tongue tab, that is still connected to its base by the lid surface 3, is pressed back into the lid surface plane directly after its punching out such that the original appearance practically results for the lid surface, but now with a microgap 8 produced by the punching procedure. After this machining, the lid unit can be further processed like a normal, single-part structure.

Instead of the toothed arrangement shown in the drawing, different, optionally simpler, gap line extents can be implemented in accordance with the invention in the punching procedure, wherein, however, the opening region or the tongue tab 4 in every case remains connected to the lid surface 3 via a pivot bearing region 9 and the microgap is covered by the molded plastic part.

Figure 4:
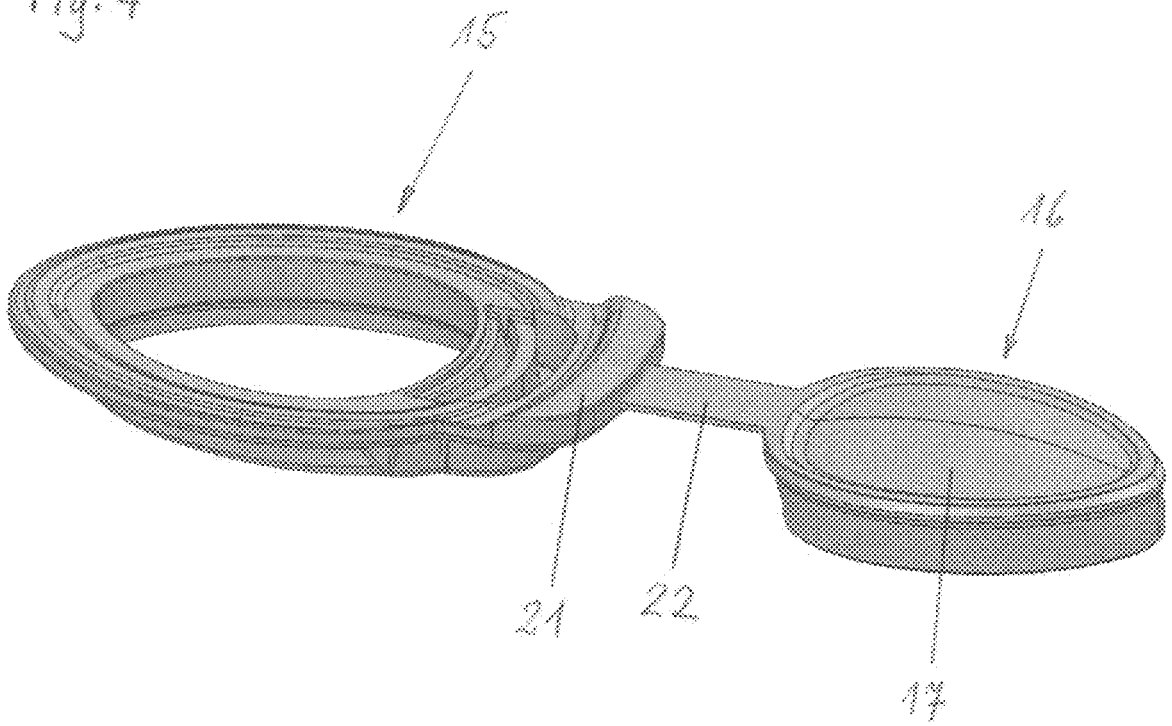
FIG. 4 is a perspective representation of the molded part injection molded in one part for forming the stopper part and the ring-shaped molded part receiver.

The perspective representation in accordance with FIG. 4 shows an embodiment of the molded plastic part 15 and of the plastic stopper part 16 as a single-part injection molded part. The ring-shaped molded part 15 and the stopper part 16 are in this respect connected via a tab 22, whereby it is possible without problem as part of an automatic production to press the stopper part through a pivot procedure into the molded part and to latch it therein so that then the sealing of this then practically single-part component with the lower lid surface can take place in the already described manner. The tab 22 can be removed when it is no longer required.

The perspective representation in accordance with FIG. 5 shows the previously already described embodiment of a can lid in a partly open state.

To reach this state, the ring-shaped longer lever 5 has to be gripped and pivoted upwardly, whereby the shorter part 6 of the two-armed lever is pressed toward the lid surface 3 that is stable in its support region and as a consequence thereof a prying open effect is produced with respect to the tongue tab 5 bearing the stopper part 16.

The tongue tab 4 and the stopper part 16 firmly connected thereto can then be upwardly pivoted and held in the end position in a simple manner only requiring a little force via the pivot bearing region 9.

It can also be seen from FIG. 5 that the toothed elements associated with the microgap are disposed in protected regions, i.e. in practically contact-free regions, both at the lid side and at the stopper side.

The stopper part 16 can be pressed out of the pivoted-open state in which the can opening is completely released back into the closed position in which the can is again sealingly closed without problem. A repeat opening procedure practically takes place in an analog way to the original opening procedure.

Figure 6:
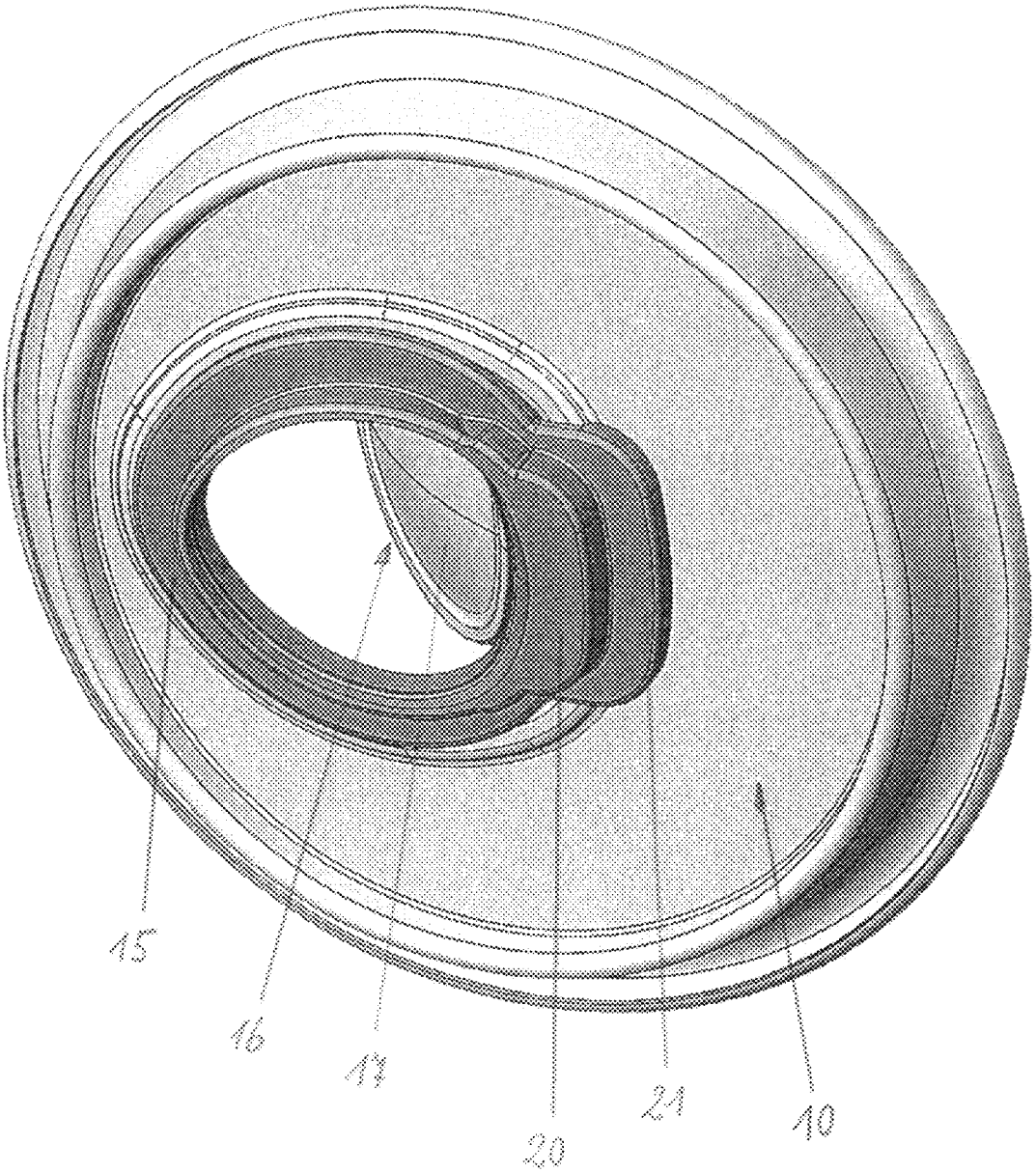
FIG. 6 is a perspective representation of the can lid of FIG. 1 from below in a partly exposed condition.

The perspective view in accordance with FIG. 6 show a bottom view of the partly open can lid in accordance with FIG. 5. In this respect, both the ring-shaped molded plastic part 15 with its noses 20, 21 and the stopper part 16 sealingly engaging into this molded part 15 and with the arched base wall 17 can be recognized. The lower side or inner side of the can lid is covered by a sealing layer 10 in the manner already mentioned a number of times.

Not only the simplicity of the solution in accordance with the invention becomes clear in this illustration, but also the flat construction producing a small space requirement. The ratio of stopper diameter to stopper depth is, for example, in the range of approximately 5 to 6 to 1.

As described, not only substantial disadvantages of the previously known and widespread can lids are avoided by the invention, but at the same time a reclosing capability of a can is achieved that substantially increases the practical value, with it being of special importance that all these advantages are obtained without any substantial increase in technical production effort.

The closure opening and reclosing system described for a can lid here can also be used in an analog manner for other containers and packages that are to be equipped with a tear closure.

REFERENCE NUMERAL LIST

1 can lid
2 bead rim
3 lid surface
4 tongue tab and opening region
5 lever arm, long
6 lever arm, short
7 fastening point
8 microgap
9 pivot bearing region
10 sealing layer
12 projection
13 recess
14 stiffening region
15 ring-shaped molded plastic part
16 plastic stopper part
17 base wall
18 cut-out
19 projection
20 molded part nose
21 molded part end region
22 tab
23 support
24 free space

The invention claimed is:

1. A can lid, the can lid comprising:

an opening region in the form of a tongue tab that is provided in metallic lid material of a lid surface;

a two-armed lever member intended for opening this opening region, the two-armed lever member being firmly connected to the lid material in the opening region, and the two-armed lever member being configured to serve for an upward pivoting of the tongue tab during the opening procedure, a substantially ring-shaped molded plastic part, with the substantially ring-shaped molded plastic part being fastened to a lower side of the lid surface while surrounding the opening region to form an opening that can be sealingly closed again; and a plastic stopper part, the plastic stopper part being firmly connected to the lower side of the tongue tab, the tongue tab being able to be pivotably opened during the opening procedure and the plastic stopper part sealingly engaging into the molded part.

2. The can lid in accordance with claim 1, wherein the can lid is configured for use with beverage cans.

3. The can lid in accordance with claim 1, wherein the peripheral contour of the tongue tab is disposed in the region of the molded part at a predefinable spacing from the stopper part.

4. The can lid in accordance with claim 1, wherein the opening region is bounded by a material weakening.

5. The can lid in accordance with claim 1, wherein the two-armed lever member is firmly connected to the lid material in the opening region via one of a rivet connection and a weld connection.

6. The can lid in accordance with claim 1, wherein the stopper part is configured as a hollow stopper having a concave base wall and can be coupled to the molded part receiving it via a snap-in connection.

7. The can lid in accordance with claim 1, wherein the molded part and the stopper part are sealingly connected to the lid material via a sealing layer.

8. The can lid in accordance with claim 7, wherein the sealing layer extends over the total lower lid side.

9. The can lid in accordance with claim 7, wherein the ring-shaped molded part has a nose that is associated with the region of the tongue tab end and whose end region is fixedly connected to the lid material via the sealing layer.

10. The can lid in accordance with claim 1, wherein the molded part and the stopper part comprise an injection molded part connected via a flexible, separable tab.

11. The can lid in accordance with claim 1, wherein the tongue tab connected to the stopper part at the lower side is separated from the lid surface by a microgap extending over the periphery of the tongue tab; and wherein a tongue tab base connected to the lid surface forms a pivot bearing that becomes effective during the opening procedure; and wherein the lower side of the metallic lid is firmly adhesively coated with a sealing plastic material.

12. The can lid in accordance with claim 11, wherein the microgap is a stamped gap.

13. The can lid in accordance with claim 1 wherein the tongue tab of the metallic can lid is separated from the lid surface surrounding it while forming mutually engaging projections and recesses by a cutting procedure; and wherein the tongue tab and the lid surface adjacent thereto are connected via the projections and recesses in a shape-matched and force-transmitting manner while forming a microgap, with a leak tightness of the completed, unopened can lid being ensured by the molded plastic part covering the microgap, with the molded plastic part being fastened to the microgap in a sealing manner.

14. The can lid in accordance with claim 13, wherein the cutting procedure is a punching procedure.

15. A can lid in accordance with claim 13, wherein the projections and the recesses are coupled via undercuts.

16. The can lid in accordance with claim 15, wherein the projections and the recesses engage into one another in the manner of a dovetail, a trapeze or a wavy line.

17. The can lid in accordance with claim 1, wherein latching elements formed by a bead formation in the material of the lid surface are provided for a releasable holding of the open-pivoted tongue tab bearing the stopper part in its open-pivoted end position.

18. The can lid in accordance with claim 1, wherein stabilizing beads are formed in the pivot bearing region of the lid surface to hold back the tongue tab bearing the stopper part.

19. The can lid in accordance with claim 1, wherein the metallic two-armed lever member is connected off-center to the tongue tab bearing the stopper part and the longer arm of the two-armed lever member is formed by a grippable tab.

20. The can lid in accordance with claim 19, wherein the metallic two-armed lever member is connected at the marginal side to the tongue tab.

21. The can lid in accordance with claim 19, wherein the grippable tab is a ring tab.

22. The can lid in accordance with claim 1, further comprising a can connected to the can lid via a beaded rim.

23. A can lid, the can lid comprising:

an opening region in the form of a tongue tab that is provided in metallic lid material of a lid surface;

a stopper part, the stopper part being firmly connected to the lower side of the tongue tab, wherein the tongue tab connected to the stopper part at the lower side is separated from the lid surface by a microgap extending over the periphery of the tongue tab;

wherein a tongue tab base connected to the lid surface forms a pivot bearing that becomes effective during an opening procedure; and wherein the lower side of the metallic lid is firmly adhesively coated with a sealing plastic material.

24. A can lid, the can lid comprising:

an opening region in the form of a tongue tab that is provided in metallic lid material of a lid surface;

wherein the tongue tab of the metallic can lid is separated from the lid surface surrounding it while forming mutually engaging projections and recesses by a cutting procedure; and wherein the tongue tab and the lid surface adjacent thereto are connected via the mutually engaging projections and recesses in a shape-matched and force-transmitting manner while forming a microgap, with a leak tightness of the completed, unopened can lid being ensured by a sealed on molded plastic part covering the microgap.

* * * * *